United States Patent [19]

Ramella

[11] Patent Number: 4,538,817

[45] Date of Patent: Sep. 3, 1985

[54] BALLOON TARGET GAME APPARATUS

[75] Inventor: Joseph Ramella, Welland, Canada

[73] Assignee: Louis E. Bonomi, St. Catherines, Canada; a part interest

[21] Appl. No.: 638,259

[22] Filed: Aug. 6, 1984

[51] Int. Cl.[3] ..... A63F 9/02

[52] U.S. Cl. ..... 273/380; 273/58 K; 273/428; 446/61; 446/220

[58] Field of Search ..... 273/380, 346, 58 K, 273/60 R, 60 A, 60 B, 65 EG, 428, 86 R; 446/220, 222, 224

[56] References Cited

U.S. PATENT DOCUMENTS

| | | | |
|---|---|---|---|
| 1,366,004 | 1/1921 | Jacobs | 273/380 |
| 1,931,429 | 10/1933 | Buckner et al. | 273/65 EG |
| 3,092,388 | 6/1963 | Wagenheim | 273/380 |

FOREIGN PATENT DOCUMENTS

| | | | |
|---|---|---|---|
| 17455 | of 1899 | United Kingdom | 273/346 |

*Primary Examiner*—Anton O. Oechsle

*Attorney, Agent, or Firm*—Christel, Bean & Linihan

[57] ABSTRACT

A balloon target game apparatus including an inflated balloon and a throwable article for throwing at the inflated balloon utilizes a grit-covered, abrasive surface for bursting the balloon upon contact with the balloon when the balloon is struck by the throwable article. In one aspect of the invention, the abrasive surface is defined by a surface of the throwable article. In another aspect of the invention, the game apparatus includes a backing article, and the abrasive surface is defined by a surface of the backing article. The backing article is positionable in relationship to the inflated balloon so that when the balloon is struck by the throwable article, the balloon is moved into contact with the abrasive surface.

11 Claims, 6 Drawing Figures

Fig. 1.
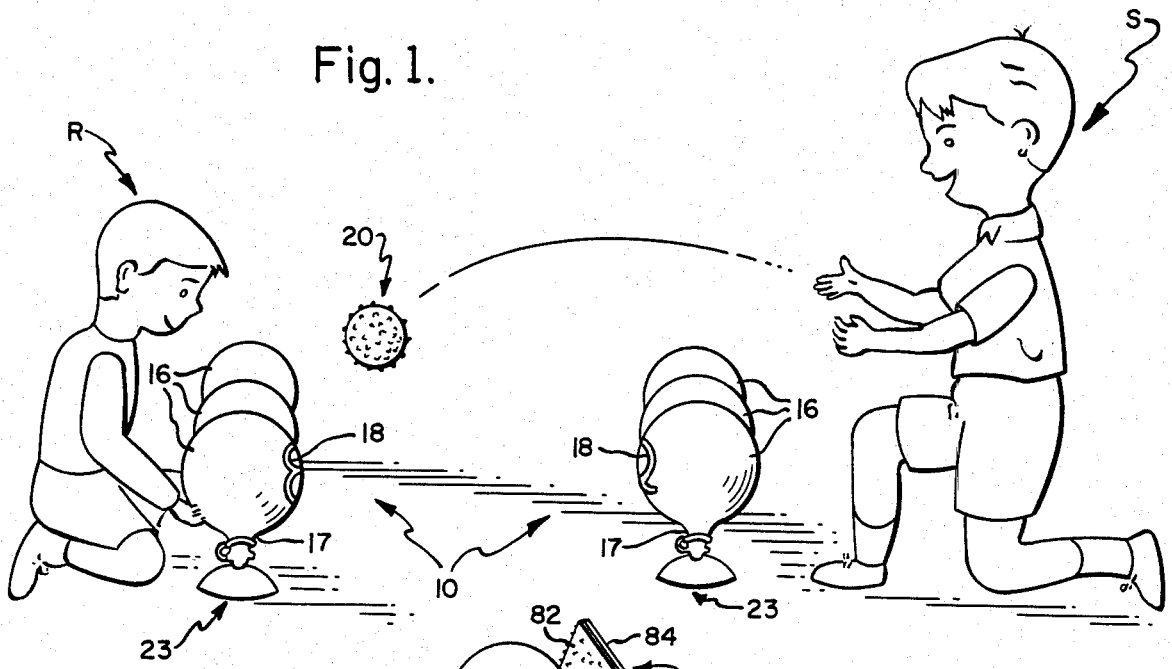
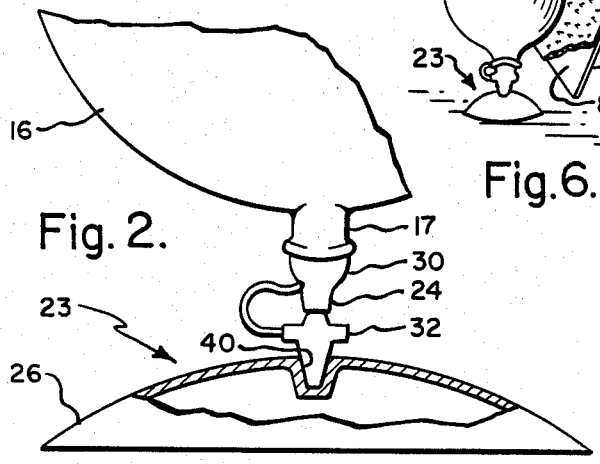
Fig. 2.
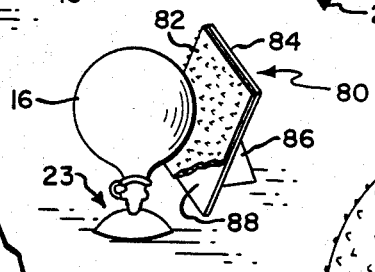
Fig. 6.
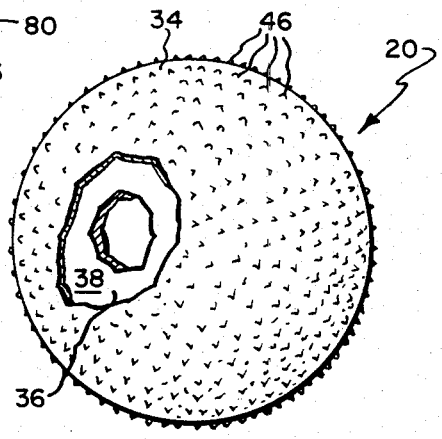
Fig. 3.
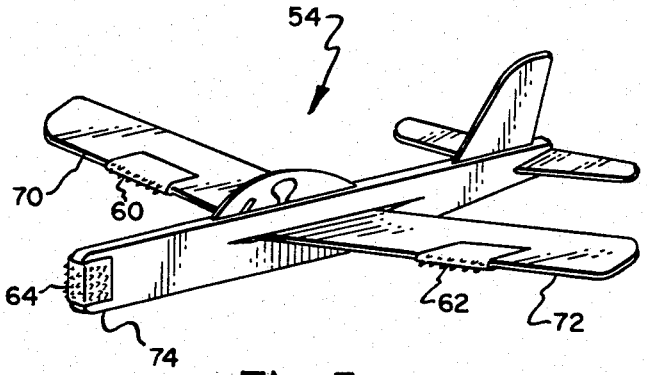
Fig. 5.
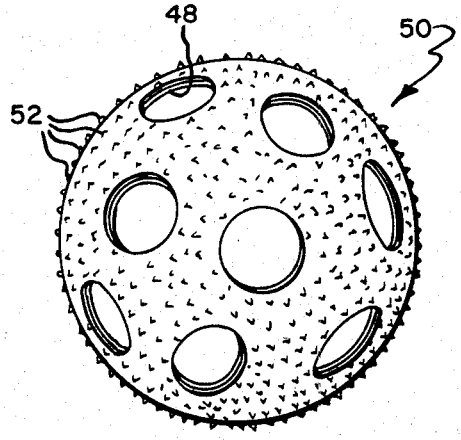
Fig. 4.

BALLOON TARGET GAME APPARATUS

BACKGROUND OF THE INVENTION

This invention relates, in general, to game apparatus and relates, more particularly, to a balloon target game apparatus.

The balloon target game apparatus with which this invention is concerned utilizes an inflated balloon as a target, a throwable article for throwing at the balloon, and means for bursting the balloon when the throwable article strikes the balloon. One example of such a balloon game apparatus is shown and described in U.S. Pat. No. 2,247,635, and another example is shown and described in U.S. Pat. No. 4,155,552.

Commonly, the balloon-bursting means of prior art balloon game apparatus includes a sharp, pointed object for bursting the balloon when the balloon comes in contact therewith. For example, the balloon-bursting means of the apparatus in the first of the above-referenced patents is provided by the tip of a throwing dart, and the balloon-bursting means described in the second of the above-referenced patents includes a nail or spike which is fixedly positioned in such a relationship to the balloon that the balloon is impelled thereagainst when it is struck by a throwable article. Any of such balloon-bursting means is limited, however, in that its sharp, pointed object presents a hazard to persons playing with the game apparatus, and if the persons playing with the apparatus are young children, the risk of injury from the sharp object is particularly great.

Accordingly, it is an object of the present invention to provide new and improved balloon-bursting means for use in a balloon target game.

Another object of the present invention is to provide such balloon-bursting means for a balloon game apparatus which is safe for use by persons and, in particular, young children who play with the game apparatus.

Still another object of the present invention is to provide a new and improved toy for throwing at and bursting an inflated balloon.

Yet still another object of the present invention is to provide a new and improved balloon game apparatus which utilizes an inflated balloon as a target and a toy for throwing at the balloon in an attempt to burst the balloon.

A further object to the present invention is to provide such a game apparatus which is well-suited for use in a competitive setting in which skill and accuracy of players is challenged and for use in a purely amusement setting.

A still further object of the present invention is to provide such a game apparatus which is easily and economically manufactured.

SUMMARY OF THE INVENTION

This invention resides in an improvement in balloon-bursting means of balloon target game apparatus having an inflated balloon and a throwable article for throwing at the balloon. The improvement is comprised of abrasive means for bursting the balloon upon impact therewith when the balloon is struck by the throwable article. In particular, the abrasive means provides an abrasive surface for contacting and bursting the balloon when the balloon is struck by the throwable article. The abrasive surface provides an advantage when included in the balloon-bursting means of a balloon game apparatus in that it can be touched or handled with little or no risk of injury to a person playing with the game apparatus.

BRIEF DESCRIPTION OF THE DRAWING FIGURES

FIG. 1 is a perspective view of a balloon target game apparatus in which an embodiment of the present invention is utilized.

FIG. 2 is a fragmentary elevational view, shown partially cut-away, of an inflated balloon and its means of support.

FIG. 3 is a perspective view of the embodiment of FIG. 1 drawn to a slightly larger scale and shown partially cut away.

FIG. 4 is a perspective view of another embodiment of the present invention.

FIG. 5 is a perspective view of still another embodiment of the present invention.

FIG. 6 is a perspective view of yet still another embodiment of the present invention shown positioned adjacent an inflated balloon and shown partially cut away.

DETAILED DESCRIPTION OF ILLUSTRATIVE EMBODIMENTS

Referring now to the drawings in greater detail and considering first FIG. 1, there is shown a balloon target game apparatus, generally indicated 10, and two players R,S who are playing with the apparatus 10. The game apparatus 10 includes a plurality of inflated balloons 16,16 and a throwing toy 20 in accordance with the present invention. In a game played with the apparatus 10, the balloons 16,16 serve as targets and the throwing toy 20 is thrown by one or both of the players R,S in an attempt to burst a balloon 16.

Each balloon 16 is constructed of rubber and, when in an inflated condition, is generally spherical in shape. As shown in FIGS. 1 and 2, the mouth, indicated 17, of each balloon 16 is directed generally downwardly. Furthermore, each balloon 16 bears an optional image or FIG. 18. Since the balloons 16,16 serve as targets during a game, the images printed on the balloons can enhance the enjoyment of a game. If, for example, each balloon bears the image of an identifiable villian, the enjoyment of the game is enhanced if a player sees as his object, in addition to the bursting of a balloon, the elimination of a villian.

Associated with each inflated balloon 16 and as best shown in FIG. 2, is a support means, generally indicated 23, for supporting the balloon 16 in relatively fixed condition. The support means 23 includes a balloon stopper 24 and a base 26 which, as will be described hereinafter, cooperate with one another to hold an inflated balloon 16 generally upright upon a substantially horizontal surface.

Each stopper 24 includes a valve portion 30 and a plug 32 which are connected to one another by means of a stem 34. The valve portion 30 of each stopper 24 has an end portion, or the upper end portion as shown in FIG. 2, which is insertable in the mouth 17 of a balloon 16 for closing the mouth 17 and another end portion, or the lower end portion as shown, which is adapted to accept a portion of the plug 32. Provided in the valve portion 30 is a flow passage (not shown) which extends between the upper and lower end portions and through which air can be pumped into a balloon mouth 17. A one-way valve (not shown) is included in the flow passage for permitting air to pass into the balloon, but not out of it. Thus, the valve portion 30 of each stopper includes means by which each balloon can be quickly and easily inflated and means for preventing the escape of air from the balloon, once the balloon is inflated.

The plug 32 of each stopper 24 has an end, or upper end as shown in FIG. 2, which is of such size and shape to be snuggly accepted by the lower end portion of the valve portion 30 and thereby stop the valve flow passage. The upper end of the plug 32 thus provides means, in addition to the one-way valve, for preventing the escape of air out of the balloon mouth 17. The other end, or the lower end as shown, of the plug 32 is conically shaped for a reason hereinafter apparent. Each of the stopper 24 and plug 32 of the valve portion 30 are constructed of a suitable material, such as plastic, and can be formed or molded together as a unitary piece.

Referring still to FIG. 2, the base 26 of the support means is in the shape of a cup and is positionable upon the ground or a similar supporting surface so that is cup opens downwardly. The material out of which the base 26 is constructed is plastic. Defined in the surface of the base 26 is a central recess 40 adapted to accept the conical end of the plug 32. More specifically, the walls of the recess are complementary in shape to that of the conical end of the plug 32 so that the conical end can be snuggly inserted in the recess 40. It will be understood from the above that when the valve portion 30 of the stopper 24 is inserted in the mouth 17 of a balloon 16 and the conical end of the plug 32 of the stopper 24 is, in turn, inserted into the base recess 40, the balloon 16 is fixed in relationship to the base 26. The base 26 and stopper 24 thereby provides means for holding a balloon 16 stationary during a game.

Referring to FIGS. 1 and 3, the throwing toy 20 includes a ball 36 which can be easily grasped and thrown. The ball is relatively light in weight and can be constructed of such materials as plastic, leather or rubber. As shown in FIG. 3, the ball 36 is hollow and defines an outer surface 38.

In accordance with the present invention, the game apparatus 10 includes abrasive means for bursting a balloon 16 when the throwing toy 20 strikes the balloon. The throwing toy 20 includes means defining an abrasive surface, indicated 34, of the toy 20, and this abrasive surface 34 provides the abrasive means of the game apparatus 10.

The abrasive surface 34 is provided by particles of grit 46 fixedly attached, as with glue or resin, to the surface 38 of the ball 36. The grit 46 which covers the surface 38 of the ball 36 is comprised of grit materials, such as garnet, aluminum oxide and silicone carbide, which are commonly associated with sandpaper. Fixedly attached to the ball surface 38, the grit 46 provides the throwing toy 20 with a course surface resembling that of sandpaper.

It has been found that the abrasive surface 34 of the toy 20 bursts an inflated balloon 16 immediately on impact with the balloon, yet the throwing toy 20 and, in particular, its abrasive surface 34 can safely be handled or touched. Thus, the throwing toy 20 is well-suited for use in a balloon target game apparatus.

A game which can be played with the game apparatus 10 has the following rules. The balloons 16,16 are initially lined in two rows, as shown in FIG. 1, with the rows being spaced about 12 ft. (3.7 m) apart. Two opposing players then stand behind a corresponding row of balloons 16,16 and take turns throwing the throwing toy 20 at the balloons positioned in the row directly in front of the opposing player. The first player who bursts all of the balloons in a row wins the game.

With reference to FIG. 4 there is shown another embodiment of a throwing toy, generally indicated 50, in accordance with the present invention. The throwing toy 50 includes a throwable article in the form of a hollow ball 48 having a plurality of relatively large holes disposed over the surface thereof. Particles of grit 52 are glued to the outer surface of the ball 48 so as to provide the throwing toy 50 with an abrasive surface.

With reference to FIG. 5 there is shown still another embodiment of a throwing toy, generally indicated 54, in accordance with the present invention. More specifically, the throwing toy 54 includes three small strips of sandpaper 60, 62, 64 and a throwable article in the form of an airplane 56 having two wings 70, 72 and a nose 74. The strips of sandpaper 60, 62 and 64 are attached, as with glue, to the front of each wing 70, 72 and nose 74, respectively, so that the course surfaces of the sandpaper strips face outwardly. When the throwing toy 54 is thrown at an inflated balloon 16 so that one of the abrasive strips 60, 62 or 64 contacts the balloon 16, the balloon bursts. It will be understood that the throwing toy 54 is particularly well-suited for use in a balloon target game in which airplane attacks upon a target are simulated.

While the present invention has been described in several illustrative embodiments, it will be understood that numerous modifications and substitutions can be had without departing from the spirit of the invention. For example, although the abrasive means have been described and shown above as being included as part of a throwing toy, the invention is not necessarily so limited. For example, there is shown in FIG. 6 a stand, generally indicated 80, having an abrasive surface 82 and which is positionable in such a relationship with an inflated balloon 16 that when a throwable article strikes the balloon 16, the balloon is moved into contact with the abrasive surface 82. The stand 80 is comprised of a rectangular piece 84 of wood and a triangular piece 86 of wood which are attached together, as with nails, to provide an easel-like structure. The exposed side, indicated 88, of the rectangular piece 84 is covered with particles of grit so as to provide the stand 80 with its abrasive surface 82. When the stand 80 is placed adjacent the balloon and on the side of the balloon diametrically opposite that of a player, an article thrown by the player and which strikes the balloon 16 forces the balloon 16 into contact with the abrasive surface 82. The slightest contact between the surface of the inflated balloon 16 and the abrasive surface 82 of the stand 80 causes the balloon 16 to burst. Accordingly, the aforedescribed embodiments are intended for purposes of illustration and not as limitation.

I claim:

1. In a balloon target game apparatus including an inflated balloon and a throwable article for throwing at the inflated balloon, the improvement comprising:

abrasive means for bursting the balloon upon contact therewith when the balloon is struck by the throwable article, said abrasive means including particles of grit which define an abrasive surface for contacting the balloon when the balloon is struck as aforesaid.

2. The improvement of claim 1 wherein the particles of grit are attached to the throwable article so as to provide the article with an abrasive surface.

3. The improvement of claim 1 wherein said abrasive means is positionable in such relationship with the inflated balloon that when the balloon is struck by the throwable article, the balloon is moved into contact with said abrasive surface of said abrasive means.

4. The improvement of claim 3 wherein said abrasive means includes a stand positionable adjacent the inflated balloon and said abrasive surface is provided by a surface of said stand.

5. The improvement of claim 1 wherein said particles of grit are sandpaper grit.

6. A throwing toy for throwing at and bursting an inflated balloon, said toy comprising:

a throwable article; and abrasive means attached to the surface of said article for bursting the balloon upon contact therewith when the balloon is struck by the abrasive means of the throwable article, said abrasive means including particles of sandpaper grit for providing said article with an abrasive surface.

7. A balloon target game apparatus comprising:

an inflated balloon;

a throwable article for throwing at the inflated balloon; and abrasive means for bursting the balloon upon contact therewith when the balloon is struck by the throwable article, said abrasive means including particles of grit which define an abrasive surface for contacting the balloon when the balloon is struck as aforesaid.

8. Apparatus as defined in claim 7 wherein said particles of grit are attached to the throwable article so as to provide said article with an abrasive surface.

9. Apparatus as defined in claim 7 wherein said abrasive means is positionable in relationship with the inflated balloon so that when the balloon is struck by the throwable article, the balloon is moved into contact with said abrasive surface.

10. Apparatus as defined in claim 7 wherein said abrasive means includes a stand positionable adjacent the inflated balloon and said abrasive surface is provided by a surface of said stand.

11. Apparatus as defined in claim 7 wherein said particles of grit are sandpaper grit.

* * * * *